US005992270A

United States Patent [19]

Hedelin et al.

[11] Patent Number: 5,992,270

[45] Date of Patent: Nov. 30, 1999

[54] SHOCK ABSORBING HAMMER

[75] Inventors: Joakim Hedelin, Västra Frölunda; Hans Brok, Borås, both of Sweden

[73] Assignee: Hultafors AB, Hultafors, Sweden

[21] Appl. No.: 09/029,942

[22] PCT Filed: Sep. 6, 1996

[86] PCT No.: PCT/SE96/01115

§ 371 Date: Mar. 11, 1998

§ 102(e) Date: Mar. 11, 1998

[87] PCT Pub. No.: WO97/16277

PCT Pub. Date: May 9, 1997

[51] Int. Cl.[6] ..... B25D 1/12

[52] U.S. Cl. ..... 81/22

[58] Field of Search ..... 81/20, 22; 403/465, 403/466, 468, 469

[56] References Cited

U.S. PATENT DOCUMENTS 2,451,217 10/1948 Heinrich .
3,172,438 3/1965 Gianelli .
4,085,784 4/1978 Fish .

FOREIGN PATENT DOCUMENTS 462616 7/1990 Sweden .

*Primary Examiner*—D. S. Meislin
*Attorney, Agent, or Firm*—Birch, Stewart, Kolasch & Birch, LLP

[57] ABSTRACT

A shock absorbing hammer, comprising an elongated shaft (2) and a hammer head (1). An end portion (2*a*) of the shaft is obliquely oriented in a somewhat wider recess (6) in the hammer head (1) so as to permit a limited pivotal movement in one angular direction, the movement being damped by a shock absorbing material in said recess.

14 Claims, 1 Drawing Sheet

SHOCK ABSORBING HAMMER

This application is the national phase under 35 U.S.C. §371 of prior PCT International Application No. PCT/SE 96/01115 which has an International filing date of Sep. 6, 1996 which designated the United States of America, the entire contents of which are hereby incorporated by reference.

BACKGROUND OF THE INVENTION

1. Field of the Invention

The present invention concerns a shock absorbing hammer, comprising a shaft and a hammer head being provided with a shock absorbing material, e.g. in the form of a rubber material, a hydraulic cushioning material or the like, the purpose being to dampen the rebound force and vibrations imparted to the shaft when the hammer head hits an object during a swinging motion of the hammer.

2. Description of the Related Art

There are many examples of hammers of this general kind, see e.g. U.S. Pat. No. 2,451,217, U.S. Pat. No. 3,172,438, U.S. Pat. No. 4,085,784 and SE-B-462,616. The last-mentioned document discloses a hammer, wherein an end portion of the shaft is mounted in a recess in the hammer head so as to permit a limited pivotal movement, being damped by a shock absorbing material, in one angular direction from a rest position when the hammer head strikes an object during a swinging motion of the hammer, whereas mutual movement in the opposite angular direction from said rest position is inhibited. Accordingly, the hammer can either be used in the normal way for striking an object, e.g. a nail, with the hammer head or, alternatively, for withdrawing a fastener, e.g. a nail, by means of a claw portion at the back of the hammer head.

However, this known hammer is relatively complicated in its structure, namely with radially projecting lugs formed at the shaft end portion in order to ensure a direct surface contact between the shaft and the hammer head inside the recess, the latter being substantially parallel to but wider than the shaft end portion. In some embodiments there are also internal, especially adapted recess portions, in addition to a simple cylindrical bore in the hammer head, which make the production thereof even more complicated and expensive.

SUMMARY OF THE INVENTION

A primary object of the present invention is to provide a shock absorbing hammer of the kind defined in the preamble of claim 1 which has a simple structure and is inexpensive to manufacture and which provides an effective shock absorbtion.

This object is achieved in that the shaft end portion and the recess in the hammer head are both cylindrical, the cylindrical recess in the hammer head being obliquely inclined in relation to the cylindrical shaft end portion, so as to provide wedge-like upper and lower recess portions, which accommodate the shock absorbing material and permit a limited pivotal movement in one angular direction, and in that, in the rest position, the shaft end portion is in surface contact with the inside wall of the obliquely inclined cylindrical recess at diagonally opposite locations directly, i.e., without the intermediary of said shock absorbing material, whereby mutual movement in the opposite angular direction is inhibited.

The manufacture of a hammer according to the invention is simple. Thus, it is sufficient to make a downwardly inclined bore hole in the hammer head, as seen from the side of the shaft, and to insert the cylindrical shaft end portion, which has a smaller diameter, into the bore horizontally, so that the shaft end portion makes direct contact with the walls of the bore adjacent to the front end of the shaft, normally near the bottom of the hole, and adjacent to the opening of the bore, whereby the shaft end portion, and the central axis thereof, will extend at an angle, normally 3°–10°, preferably about 4°, relative to the bore axis.

In this way, there will remain a lower recess portion with increasing vertical thickness from the location of contact near the opening of the hole to the bottom thereof, and an upper recess portion with increasing thickness in the opposite direction. These recess portions are shaped somewhat like a wedge, at least as seen in a vertical section, and are filled with a shock absorbing material. Because of this wedge-like configuration, the dampening and shock absorbing power of the shock absorbing material will be uniform and effective along the full length of the shaft portion inserted into the cylindrical bore in the hammer head.

Preferably, the cylindrical bore in the hammer head is lined internally by a cylindrical sleeve, fitted tightly in the bore, so that the interior of the sleeve constitutes the recess into which the shaft end portion is inserted. Advantageously, the sleeve is made of metal and is provided with deformed portions near its ends, at the upper side near the bottom of the bore and at the lower side near the opening of the bore, these deformed portions extending radially inwards so as to provide the desired surface contact between the recess and the shaft end portion.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DESCRIPTION OF A PREFERRED EMBODIMENT

Figure 1:
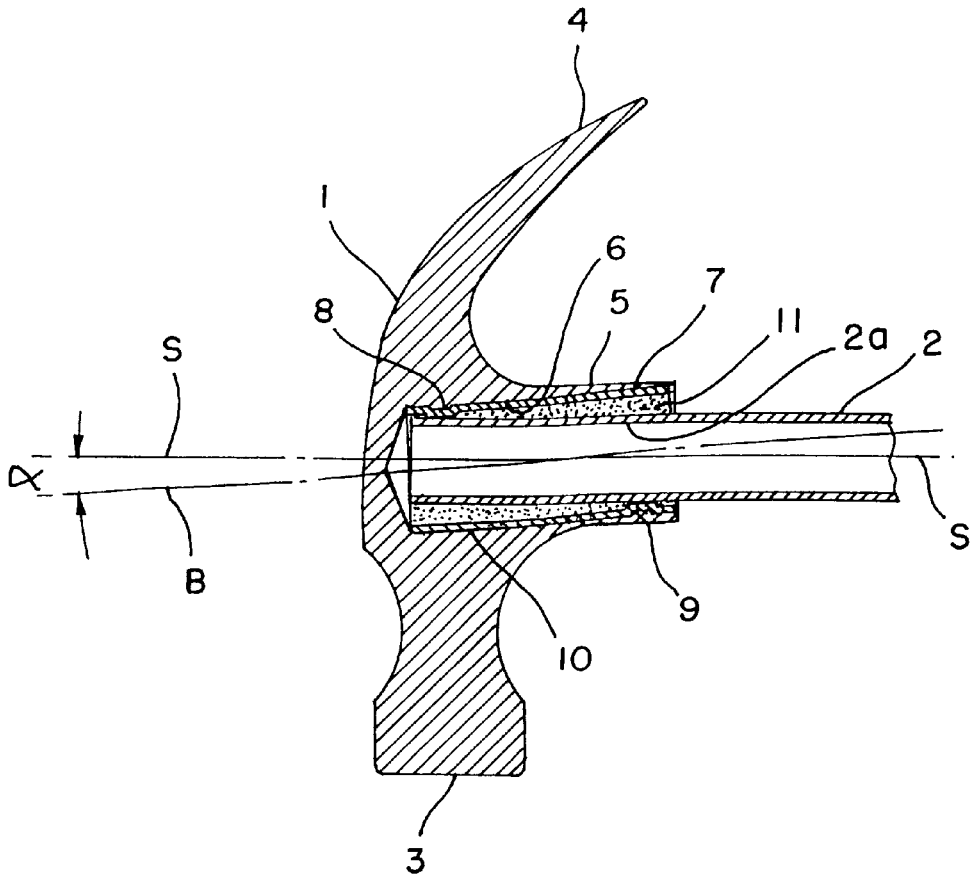
FIG. 1 is a sectional view of the hammer head and the shaft end portion of a hammer according to the invention.

The illustrated hammer comprises a conventional hammer head 1 which is resiliently connected to an end portion 2*a* of a tubular shaft 2, e.g. made of metal or a reinforced plastic material. The other end of the shaft (not shown in FIG. 1) is provided with a gripping handle, as is well-known in the art of hand tools of this kind.

The hammer head has a lower striking surface 3 and an upper claw portion 4, the latter being used for withdrawing nails or the like. A mid-portion of the hammer head 1 includes a substantially cylindrical portion 5 projecting backwards in parallel to the axis S of the shaft 2, to the right in FIG. 1, to provide a secure connection with the shaft 2. A cylindrical bore 6, the diameter of which is somewhat larger than the external diameter of the tubular shaft 2, is made at a small angle α, about 4° in the illustrated embodiment, so that the bore axis B is slightly inclined downwards towards the front end, to the left in FIG. 1, relative to the horisontal axis S of the shaft 2 and the hammer head portion 5.

Figure 2:
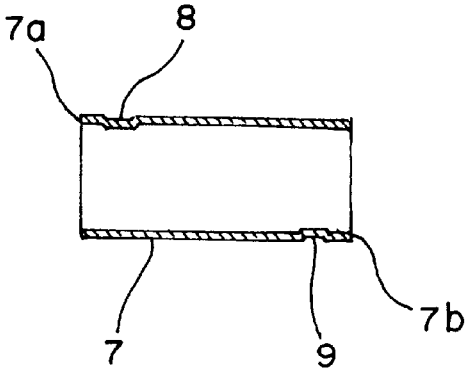
FIG. 2 shows a sleeve separatedly in a longitudinal section along the line A—A in FIG. 3, the sleeve forming a part of the connection between the shaft and the hammer head.
Figure 3:
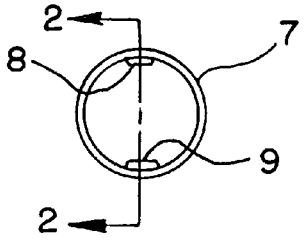
FIG. 3 shows an end view of the sleeve of FIG. 2.

A bushing or sleeve 7 (compare FIGS. 2 and 3), made of a metal material, preferably steel, is press-fitted into the bore 6, so that the interior of the sleeve constitutes a cylindrical recess firmly integrated with the hammer head 1. The shaft 2 is inserted with its end portion 2*a* into this recess, the axis S thereof being oriented horisontally or in parallel to the cylindrical, backwardly projecting portion 5 of the hammer head 1. Consequently, the forward, upper end of the shaft end portion 2*a* makes direct contact with the innermost end 7*a* of the sleeve 7 and the rear, lower end of the shaft end portion 2*a* makes direct contact with the outer end 7*b* of the sleeve. This contact is well-defined and distributed over a surface area by means of inwardly deformed material portions 8 and 9, respectively, at each location.

Because of the inclinational angle a between the sleeve 6 and the shaft end portion 2*a*, there are formed wedge-like recess portions 10 and 11 between the inside of the sleeve 7 and the outside of the shaft end portion 2*a*, the thickness increasing towards the bottom of the recess at the lower side (10) and in the opposite direction at the upper side (11). Of course, in the circumferential direction, the thickness of these recess portions will increase downwards at the front end 7*a* of the sleeve and upwards at the rear end 7*b* of the sleeve 7. The recess portions 10 and 11 are filled with a shock absorbing material, e.g. of rubber, foam, an elastically resilient plastic material or the like, which secures a permanent connection between the hammer head 1 and the shaft 2, on one hand, and provides the desired shock absorbing effect therebetween, on the other hand.

During use in the normal way, when the hammer strikes an object such as a nail, the hammer head 1 will be retarded and bounce back upwards, whereas the shaft 2, which is held in the hand of the user, still has a momentum directed downwards. The mutual movement is such that the hammer head 1 will impart an upwardly directed force onto the shaft end portion 2*a* at the location of direct surface contact with the deformed material portion 9, at the rear end of the shaft end portion 2*a*. Because of the relative upward movement of the hammer head 1, the latter will perform a pivotal movement around the last-mentioned location of direct contact. This relative pivotal movement will be effectively damned and retarded by the shock absorbing material in the wedge-like recess portion 10. During this process, a large part of the kinetic energy will be absorbed and be transformed into thermal energy. Therefore, the shock impact onto the shaft and handle of the hammer will be considerably reduced.

The structure of the hammer according to the invention may be modified by those skilled in the art within the scope of the appended claims. For example, the "cylindrical" shape of the hammer head recess and the shaft end portion includes also non-circular cross-sectional configurations, e.g. a rectangular cross-section. The crucial feature is the obliquely inclined orientation of the shaft end portion within the hammer head recess.

We claim:

1. A shock absorbing hammer, comprising:

a shaft;

a hammer head having a recess defined therein, said hammer head being obliquely inclined in relation to said shaft and being mounted on said shaft via said recess;

upper and lower wedge portions formed in a space between said recess and said shaft, said upper wedge portion increasing in angle size in a gripping direction of said shaft and said lower wedge portion increasing in angle size in a direction opposite of said gripping direction of said shaft; and shock absorbing material provides in said upper and lower wedge portions, said shock absorbing material dampening a shock when a force is applied to said hammer head.

2. The shock absorbing hammer as defined in claim 1, wherein a cylindrical sleeve of hard and wear-resistant material is inserted radially between an end portion of said shaft and said recess in the hammer head, said sleeve having at least one radially protruding portion on opposite and opposing ends thereof, whereby said protruding portions provide surface contact locations for said end portion of said shaft.

3. The shock absorbing hammer as defined in claim 2, wherein said cylindrical sleeve is fitted tightly in said recess, the interior of said sleeve thereby constituting said recess.

4. The shock absorbing hammer as defined in claim 3, wherein said protrusions extend radially inwards.

5. The shock absorbing hammer as defined in claim 2, wherein said protrusions are constituted by deformed portions of the sleeve material.

6. The shock absorbing hammer as defined in claim 2, wherein said cylindrical sleeve is made of metal.

7. The shock absorbing hammer as defined in claim 1, wherein the shaft is constituted by a cylindrical member of a strong material.

8. The shock absorbing hammer as defined in claim 7, wherein the cylindrical shaft member is tubular.

9. The shock absorbing hammer as defined in claim 1, wherein an end portion of said shaft is in contact with said recess on an upper end surface thereof.

10. The shock absorbing hammer as defined in claim 9, wherein an intermediate portion between a gripping location and said upper end portion of said shaft is in contact with said recess on a lower open end surface thereof.

11. The shock absorbing hammer as defined in claim 10, wherein said end and intermediate portions define said oblique incline of said hammer head and prevent pivotal movement of said hammer head in a direction of said oblique incline.

12. The shock absorbing hammer as defined in claim 1, wherein said shock absorbing material allows limited pivotal movement of said hammer head in relation to a reaction force applied to said hammer head.

13. The shock absorbing hammer as defined in claim 3, wherein an end portion of said shaft is in contact with said recess on an upper end surface defined by at least one radially protruding portion.

14. The shock absorbing hammer as defined in claim 13, wherein an intermediate portion between a gripping location and said upper end portion of said shaft is in contact with said recess on a lower open end surface defined by another of at least one radially protruding portion.

* * * * *